US007312678B2

(12) United States Patent
Ning et al.

(10) Patent No.: US 7,312,678 B2
(45) Date of Patent: Dec. 25, 2007

(54) MICRO-ELECTROMECHANICAL RELAY

(75) Inventors: Yuebin Ning, Edmonton (CA); Graham Hugh McKinnon, Edmonton (CA); Cameron Raymond Howey, Edmonton (CA); Michael John Colgan, Edmonton (CA)

(73) Assignee: Norcada Inc., Edmonton (CA)

( * ) Notice: Subject to any disclaimer, the term of this patent is extended or adjusted under 35 U.S.C. 154(b) by 319 days.

(21) Appl. No.: 11/028,620

(22) Filed: Jan. 5, 2005

(65) Prior Publication Data

US 2006/0145793 A1 Jul. 6, 2006

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,423,401 | A | 12/1983 | Mueller | |
| 5,258,591 | A | 11/1993 | Buck | |
| 5,578,976 | A | 11/1996 | Yao | |
| 5,955,817 | A | 9/1999 | Dhuler et al. | |
| 6,239,685 | B1 | 5/2001 | Albrecht et al. | |
| 6,275,320 | B1 * | 8/2001 | Dhuler et al. | 359/237 |
| 6,456,190 | B1 * | 9/2002 | Andersson et al. | 337/365 |
| 6,549,107 | B2 | 4/2003 | Lim et al. | |
| 6,570,750 | B1 | 5/2003 | Calcatera et al. | |
| 6,684,638 | B2 | 2/2004 | Quenzer et al. | |
| 6,753,582 | B2 | 6/2004 | Ma | |
| 6,801,682 | B2 | 10/2004 | Zhang et al. | |
| 6,977,569 | B2 * | 12/2005 | Deligianni et al. | 335/78 |
| 7,092,272 | B1 * | 8/2006 | Gilkey et al. | 365/78 |

OTHER PUBLICATIONS

William C. Tang, Tu-Cuong H. Nguyen and Roger T. Howe: "Laterally Driven Polysilicon Resonant Microstructures"; Proceedings of IEEE.
Micro Electro Mechanical Systems, Feb. 1989; p. 53-59.
Yongxun Liu et al: "A Thermomechanical Relay With Microspring Contact Array"; Proceedings of IEEE; 2001; p. 220-223.
Don Yan, "Mechanical Desgin and Modeling of MEMS Thermal Actuators for RF applications", Thesis (University of Waterloo), at least as early as Dec. 2002, Waterloo, Canada.
Don Yan et al., "Design and modeling of a MEMS bidirectional vertical thermal actuator", J. Micromech. Microeng., May 13, 2004, 841-850, 14-7, Inst. of Physics Pub., Bristol UK.

* cited by examiner

*Primary Examiner*—Elvin Enad
*Assistant Examiner*—Bernard Rojas

(57) ABSTRACT

The present invention provides a micro-electromechanical relay that can produce low electrical contact resistance, and is capable of mechanical latching. More specifically, the present invention combines the clamping actions of cantilever beams with a movable shuttle-like spacer to generate high contact forces at the metal-metal contacts of the micro-electromechanical relay, thereby producing a very low electrical contact resistance and a mechanism for mechanical latching. Methods of fabricating the micro-electromechanical relay are also provided in this invention, which offer the advantages of both design and fabrication flexibilities by processing the top and bottom substrates separately prior to joining them together.

22 Claims, 5 Drawing Sheets

MICRO-ELECTROMECHANICAL RELAY

BACKGROUND OF THE INVENTION

The present invention relates to a micro-electromechanical relay that combines clamping cantilever beams with movable shuttle structure to provide strong contact force, latching mechanism, and high standoff voltage.

Micro-electro-mechanical system or MEMS refers to micro devices that typically integrate electrical and mechanical elements on a common substrate or substrate stack using microfabrication technology. The electrical elements are typically formed using metal film deposition and patterning techniques, and the mechanical elements are normally fabricated using micromachining techniques which include deposition, lithographic patterning, and etching of various structural and sacrificial materials. Wafer bonding or mating techniques to form multi-layer substrate stack is also commonly used in the fabrication of MEMS devices. Examples of MEMS devices include accelerometers, pressure sensors, micro mirror arrays and MEMS switches to name a few.

MEMS switches generally include two classes of electrical switching devices. One class of the MEMS switches relies on capacitive coupling to switch a radio frequency or microwave signals. This type of MEMS switches only works at high frequencies. The other class of switching devices utilizes metal-metal contact to accomplish the electrical switching function. This class of MEMS switching devices works at DC as well as RF and microwave frequencies, and is usually referred to as micro-electromechanical relays.

Micro-electromechanical relays are inherently small and potentially low cost devices when compared with the conventional electromechanical devices. Micro-electromechanical relays are also capable of high performance over a wide frequency range in terms of insertion loss, isolation, and response linearity, particularly when compared to transistor and diode types of devices. Many of the micro-electromechanical relays developed use electrostatic actuation to deflect cantilever beams or some type of suspended deformable structures for switching actions. The cantilever beams or the suspended deformable structures usually have metal members attached which either serve as part of the conductor terminals or simply a metal bar to short the conductor terminals electrically. The electrostatic actuation method has the advantage of low power consumption and relatively fast switching time but suffers from low contact force inherent to this actuation method. Low contact force corresponds to small contact area and high electrical resistance at the contact, limiting the power level and the lifetime of the micro-electromechanical relay. The physical gap between the cantilever beam and the conductor terminals in the "off" state of the relay is typically on the order of a few micrometers in order to keep the actuation voltage reasonably low. This however makes the relay more susceptible to "self-actuation" caused by voltage spikes in the control lines or high voltage component carried in the signal lines. Examples of MEMS cantilever beam type of relays using electrostatic actuation method are disclosed in U.S. Pat. No. 5,258,591 entitled "Low inductance cantilever switch", in the name of inventor Buck, and U.S. Pat. No. 5,578,976 entitled "Micro electromechanical RF switch", in the name of inventor Yao.

The amount of power or current the micro-electromechanical relay can handle is not only limited by the contact resistance of the relay, the overall electrical resistance of the device also has to be kept low in order to minimize the power loss to the relay device itself. Most of the micro-electromechanical relays use thin-film conductors with thicknesses on the order of 1 μm or so for the signal terminals which tend to have relatively high values of electrical resistance for the whole device, regardless of the actuation method. A possible solution to this problem is to increase the conductor thickness to the range of 10-50 μm to reduce the overall resistance of the relay and make it robust. Electroplating is one process technique that can produce such conductors.

Other actuation methods such as shape memory alloy (SMA), electromagnetic, and thermal actuations have also been used in various designs of micro-electromechanical relays. Thermally actuated micro-electromechanical relays can usually provide the high contact force desired and the contact resistance of this type of micro-electromechanical relays can be very low. Thermally actuated relays usually have much higher power consumption compared with relays that use electrostatic actuation. U.S. Pat. No. 4,423,401 issued to Mueller described an early example of a thermally actuated micro-electromechanical relay and U.S. Pat. No. 5,955,817 issued to Dhuler et al is a more recent example of thermally actuated micro-electromechanical relay.

Most of the micro-electromechanical relays require continued application of the actuation voltage or current in order to maintain the relay in at least one of the desired "on" and "off" positions. The only exceptions are those switches that are bi-stable and capable of latching into "on" and "off" positions mechanically. Latching or bi-stable relays have the advantage of reduced power consumption as the only time power is required is during switching. Latching switches are also immune to power failures which is a feature needed by many applications.

An example of thermally actuated bi-stable micro-electromechanical relays is disclosed in U.S. Pat. No. 6,239,685 entitled "Bistable micromechanical switches", issued May 29, 2001, in the name of inventors Albrecht and Reiley. The relay has a bi-material beam actuator which relies on controlled level of built-in stress and differential thermal expansion coefficients in the bi-material stack to make the relay bi-stable. The bi-material beam in the MEMS relay described in this patent is clamped at both ends and has a limited travel distance between the "on" and "off" state which means the device will have a fairly low standoff voltage. U.S. Pat. No. 6,753,582 issued to Ma disclosed another example of thermally actuated bi-stable micro-electromechanical relays, where a pair of in-plane (lateral) movement thermal actuators is used to push a vertical leaf spring structure (a pre-deformed beam) to provide the snap action of a bi-stable switch.

One challenging issue with the use of double-clamped beam structures having built-in stress is the ability to control and maintain the stress level in the beams during the microfabrication process. The built-in stress is often achieved through deposition of films with a desired stress level, which is often difficult to control from run to run. In addition, subsequent process steps may also alter the stress level within the films, making it even more difficult to maintain the stress at a certain level in these structures. Another issue with this approach is the limited vertical travel distance of the double-clamped beam which corresponds to lower standoff voltage. Use of a pre-deformed vertical leaf spring described in U.S. Pat. No. 6,753,582 eliminates the above-mentioned problems. However, the difficulty with this approach lies in getting good profile and smooth surface finish on the vertical wall of the electrode structures required for good metal-metal contact.

U.S. Pat. No. 6,684,638 issued to Quenzer and Wagner described a micro actuator arrangement for bi-stable micro-electromechanical relay. The micro actuator arrangement combines two or more thermomechanical actuators to achieve high contact force and mechanical latching. The thermomechanical actuators are made of a single material such as electroplated nickel and are disposed on a semiconductor substrate. The micro actuator arrangement is comprised of one lateral actuator that produces movement parallel to the substrate surface in response to thermal stimulation, and one vertical actuator that produce movement perpendicular to the substrate surface in response to thermal stimulation. In the disclosed arrangement, the vertical actuator is a single beam fixed at both ends (also known as double-clamped beam) that can buckle upward in response to a temperature increase.

In general, the designs proposed and developed thus far by various groups do not have the design flexibility for the micro-electromechanical relay to provide low contact resistance, high power handling, and high stand-off voltage in the same device. Furthermore, the fabrication methods proposed so far rely on building the required electrical and mechanical elements on top of a single substrate to realize the device, an approach that is not always flexible enough to address all the design and fabrication issues. Thus, there remains a need for micro-electromechanical relays that are capable of latching, low contact resistance, high power, and high standoff voltage, as well as more flexible ways to fabricate such devices.

SUMMARY OF THE INVENTION

The present invention is directed to a micro-electromechanical relay that can produce low electrical resistance at the metal-metal contacts and is capable of mechanical latching. More specifically, the present micro-electromechanical relay combines actuating cantilever beams with a moveable shuttle-like spacer structure to generate high contact forces at the metal-metal contacts of the relay from the clamping action of the cantilever beams. The high contact forces produce larger metal-metal contact area which leads to low electrical resistance at the contact. The combination of cantilever beams with a movable shuttle structure also provides a mechanical latching mechanism for the present micro-electromechanical relay.

According to various aspects of the invention: One or more cantilever beams are attached to a base substrate at their fixed ends and free at the other ends capable of out-of-plane (substantially vertical) movement when actuated. A moveable shuttle structure is provided with a conductor plate attached to one end that can be placed underneath the cantilever beams when the cantilever beams are actuated upward (away from the base substrate surface). The other end of the shuttle structure may be attached to an actuator capable of in-plane (substantially parallel to the base substrate) movement. The base substrate may further comprise of one or more fixed conductors disposed on its surface, and the fixed conductors form part of the electrical circuit for the relay signal. Each of the cantilever beams may have a conductor layer attached to but electrically isolated from its underside, and the conductor layer forms part of the electrical circuit for the signal of the relay. To provide a latching function, when the cantilever beams are not actuated, they exert a downward clamping force to press against the shuttle structure and the conductor plate, thereby establishing the electrical connections between the conductor terminals of the micro-electromechanical relay. The downward clamping force also holds the conductor plate and the shuttle structure in place even when the actuation for the movable shuttle is turned off, providing a mechanical latching mechanism for the micro-electromechanical relay.

According to a further aspect of the invention, the cantilever beams are composed of two dissimilar materials having different thermal coefficients of expansion (TCEs), and can be thermally actuated to move upward from their flat neutral positions when heated, allowing the in-plane movement actuator to extend and place the shuttle structure underneath of the cantilever beams. When the heating is turned off, the bi-material cantilever beams will attempt to go back to their neutral positions, creating a strong clamping force upon the shuttle structure to hold the conductor plate against at least one of the conductor terminals, therefore establishing an electrical path between two conductor terminals of the relay. This device configuration provides the advantage of high contact force, a latching mechanism, and large physical gap between conductors in the "off" state to provide high standoff voltage for the present relay.

According to another aspect of this invention, the shuttle actuator for moving the shuttle structure is an electrostatic actuator, preferably one or a series of comb drive actuators such as the ones described by Tang et al. in "Laterally driven polysilicon resonant microstructures" in Proceedings of IEEE Micro Electro Mechanical Systems (pp. 53-59 February 1989).

According to yet another aspect of this invention, the shuttle actuator for moving the shuttle structure is a thermal actuator, preferably a plurality of bent-beam actuators in a series configuration for large displacement.

Further aspects of the invention provide advantageous methods of fabricating the micro-electromechanical relay which involve processing of two separate substrates independently prior to joining them together. For example, in one fabrication method, a silicon substrate is first attached to a base substrate and preferably thinned afterwards. The silicon substrate may comprise electrical conductors, mechanical structures, and other elements formed on the surface facing the base substrate, prior to its attachment to the base substrate. The cantilever beams, the movable shuttle and the shuttle actuator for the micro-electromechanical relay are then formed in the silicon layer attached to the base substrate in subsequent process steps. The base substrate can be glass, ceramic, or semiconductor wafer with TCEs closely matching that of silicon, and may further comprise of electrical conductors, mechanical structures, and other needed elements formed prior to the attachment.

In another fabrication method, a prefabricated top substrate is attached to a prefabricated base substrate to complete the final assembly of the micro-electromechanical relay. The top substrate is preferably silicon that has been processed to have all the electrical and mechanical elements fabricated, including the cantilever beams, the movable shuttle and the shuttle actuator prior to the attachment. The base substrate is preferably a glass or a ceramic substrate, with fixed conductors disposed on the surface and prefabricated electrical vias through the substrate for electrical interconnects, prior to the attachment. The base substrate material's TCE should match closely to that of the top substrate. According to a further aspect of fabrication, the top substrate and the base substrate are attached only in selected areas, to allow the cantilever beams and the shuttle structure move freely.

According to another aspect of the preferred fabrication methods of this invention, the area that is not attached between the top and bottom substrates may be defined by etched recess in the base substrate or the top substrate. The etched recess also provides the space to accommodate the signal line conductors of the relay and create the suspension of the cantilever beams. Alternatively, the recessed area can be formed by having a spacer layer between the top substrate and the base substrate in selected regions.

BRIEF DESCRIPTION OF THE DRAWINGS

There will now be described preferred embodiments of the invention, by reference to the drawings, by way of illustration, in which:

FIG. 5*b* shows a prefabricated top substrate, preferably silicon, with all actuators, cantilever beams and shuttle structures formed. FIG. 5*c* shows the final assembly of the device by mating the top substrate with the bottom substrate using wafer bonding methods.

DETAILED DESCRIPTION OF PREFERRED EMBODIMENTS

The present invention can be described in more detail with reference to the accompanying figures in which two preferred embodiments of the invention are shown and two methods of fabrication are illustrated. It should be understood, however, that there is no intent to limit the invention to the particular embodiments and methods disclosed, but on the contrary, the invention is to cover all modifications, equivalents, and alternatives falling within the scope of the invention as defined by the claims.

Figure 1:
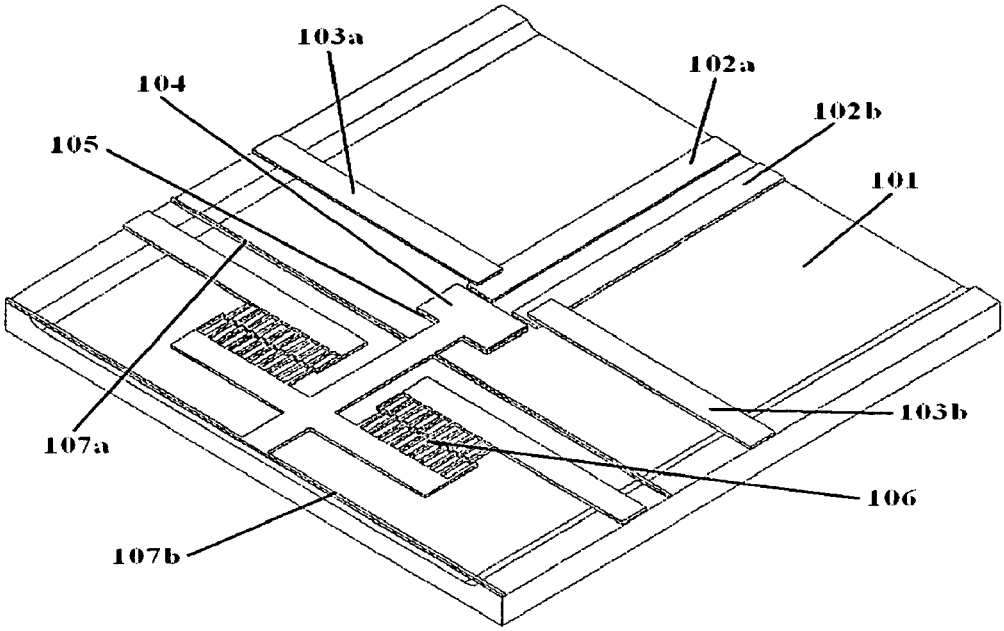
FIG. 1 is a diagrammatic isometric view of one embodiment of the device. In the "closed" state of the relay in this embodiment, the electrical current travels through a conductor on the base substrate, through a conductive plate on the shuttle, and back through a second conductor on the base substrate.

FIG. 1 is a diagrammatic isometric view of a micro-electromechanical relay in accordance with one embodiment of the present invention. The relay comprises a base substrate 101, fixed conductors 102*a*, 102*b* disposed onto the base substrate, cantilever beams 103 attached to the base substrate at their fixed ends and suspended over the fixed conductors at their free ends, and a movable shuttle structure 104 attached to a shuttle actuator 106. The fixed part of the shuttle actuator is anchored to the base substrate in selected areas. The movable part of the shuttle actuator and the shuttle structure are attached to the base substrate via springs 107 so they can move freely in the desired directions. The shuttle has a conductive plate 105 underneath. The fixed conductors and the conductive plate on the shuttle structure are preferably made from copper, gold, or other high electrical conductivity metals. The base substrate is preferably glass but can be ceramic or semiconductor having an electrically insulating surface. The shuttle actuator, preferably a comb drive structure 106 as shown in FIG. 1, is capable of substantially in-plane movement with respect to the base substrate. Springs 107*a*, 107*b* exist to provide a restoring force on the shuttle structure. The relay is open in this configuration. The first stage in closing the relay is to bend the cantilever beams 103 out-of-plane and away from the substrate 101. There is a preferred method of bending the cantilever beams, disclosed later, but the mechanisms involved are not shown on this figure for simplicity.

With the cantilever beams 103 bent away from the substrate 101, the shuttle 104 is now free to travel in-plane without interference. The preferred actuation methods to move the shuttle is through the electrostatic comb-drive actuator structure 106, but other methods now known, or hereafter developed, such as a thermal bent-beam actuator (not shown) can also be used. The second stage in closing the relay is to actuate the comb-drive structure 106, which moves the shuttle 104 forward, in-plane and to a location above the conductors 102*a*, 102*b*. The third stage in closing the relay is to relax the cantilever beams 103 so that they move downwards and clamp the shuttle 104 to the base substrate 101. An electrical current path now exists through the conductor 102*a*, the shuttle conductive plate 105, and the conductor 102*b*, allowing DC or high frequency signals to pass through in the "closed" state of the relay.

The comb-drive actuator structure 106 need not be powered in this final configuration, since the cantilever beams provide enough force to hold the shuttle in place. When the device is operated this way, it is able to maintain the "closed" state without consuming any power and is referred to as a latching micro-electromechanical relay. This is the fourth and final stage in closing the relay. To open the relay, the cantilever beams 103 need only be bent out-of-plane and away from the substrate. The shuttle then returns to its original position through a restoring force provided by the springs 107.

Figure 2:
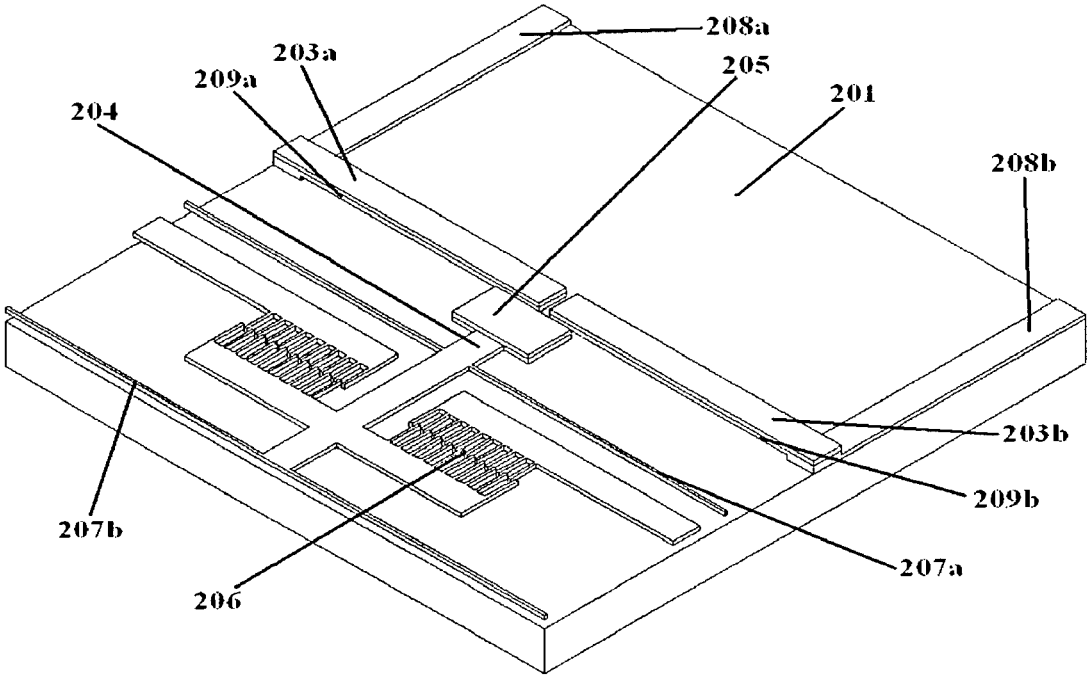
FIG. 2 is a diagrammatic isometric view of a second embodiment of the device. In the "closed" state of the relay in this embodiment, the electrical current travels through a conductive layer on one cantilever beam, through a conductive plate on the shuttle, and back through a conductive layer on a second cantilever beam.

FIG. 2 is a diagrammatic isometric view of a micro-electromechanical relay in accordance with a second embodiment of the present invention. The relay comprises a base substrate 201, cantilever beams 203 attached to the base substrate at their fixed ends and free to move in the direction vertical to the substrate, and a movable shuttle structure 204 attached to a shuttle actuator 206. The cantilever beams have conductive layers 209*a*, 209*b* underneath. The fixed part of the shuttle actuator is anchored to the base substrate in selected areas. The movable part of the shuttle actuator and the shuttle structure are attached to the base substrate via springs 207 so they can move freely in the desired directions. The shuttle has a conductive plate 205 above. The conductive layers underneath the cantilever beams and the conductive plate on the shuttle structure are preferably made from copper, gold, or other high electrical conductivity metals. The base substrate is preferably glass but can be ceramic or semiconductor having an electrically insulating surface. The shuttle actuator, preferably a comb drive structure 206 as shown in FIG. 1, is capable of substantially in-plane movement with respect to the base substrate. Springs 207 exist to provide a restoring force on the shuttle structure. The relay is open in this configuration.

The first stage in closing the relay is to bend the cantilever beams 203 out-of-plane and away from the substrate 201.

There is a preferred method of bending the cantilever beams, disclosed later, but the mechanisms involved are not shown on this figure for simplicity.

With the cantilever beams 203 bent away from the substrate 201, the shuttle structure 204 is now free to travel in-plane without interference. The preferred means of moving the shuttle is through the comb-drive actuator structure 206, although other mechanisms now known, such as a thermal bent-beam actuator, or hereafter developed, can also be used. The second stage in closing the relay is to actuate the comb-drive structure 206, which moves the shuttle 204 forward, in-plane and to a location below the cantilever beams 203. The third stage in closing the relay is to relax the cantilever beams 203 so that they move downwards and contact the conductive plate 205 on the shuttle 204. An electrical current path now exists through the conductor 208*a*, the layer 209*a*, the shuttle conductive plate 205, the layer 209*b*, and the conductor 208*b*, allowing the DC or high frequency signals to pass through in the "closed" state of the relay. The comb-drive structure 206 need not be powered in this final configuration, since the cantilever beams provide enough force to hold the shuttle in place. This is the fourth and final stage in closing the relay. To open the relay, the cantilever beams 203 need only be bent out-of-plane and away from the substrate. The shuttle then returns to its original position through a restoring force provided by the springs 207.

Figure 3A:
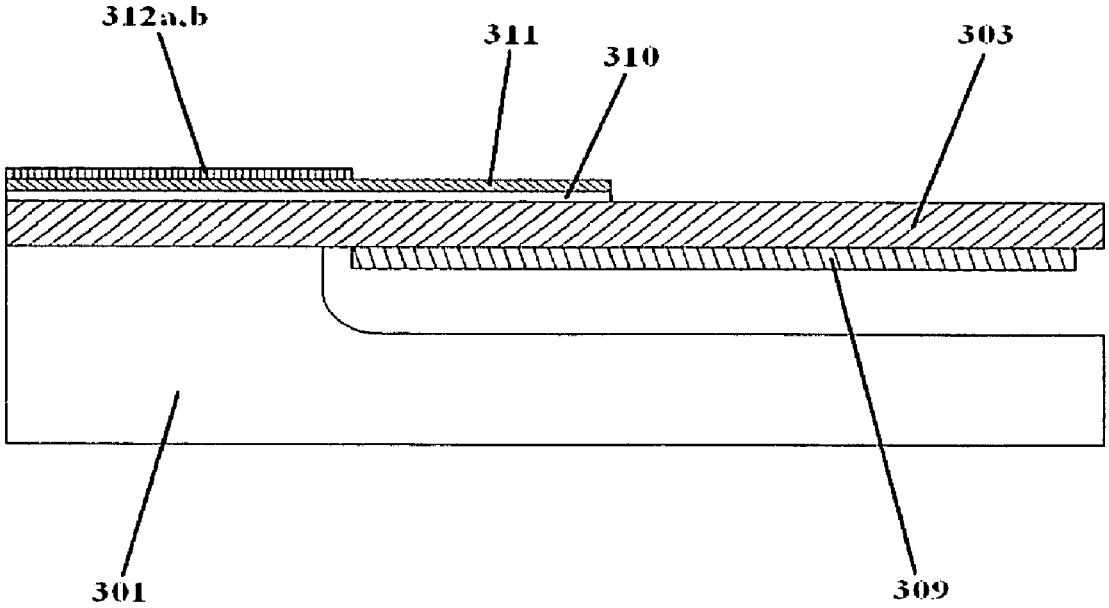
FIG. 3*a* shows the side view of one embodiment of a cantilever beam which is capable of out-of-plane bending.
Figure 3B:
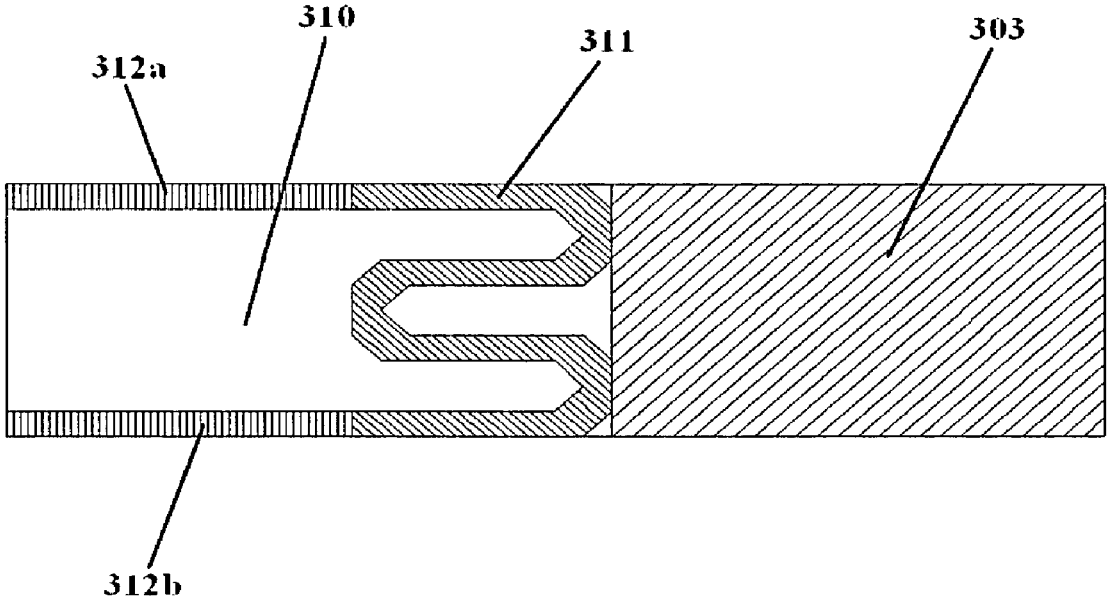
FIG. 3*b* is the top view of the same cantilever beam structure.

FIGS. 3*a*, 3*b* show one embodiment of the cantilever beams, including an actuation method of bending them. A main structural layer 303 is composed preferably of silicon, and is attached to a base substrate 301 composed preferably of glass. Underneath the main structural layer 303 is a secondary structural layer 309, which is composed of metal such as nickel or copper which possesses a dissimilar thermal expansion coefficient to the main structural layer 303. An insulative silicon-oxide layer 310 is placed on the top surface of the main structural layer 303. A thin-film such as nickel-chromium resistive heater 311 is placed on the top surface of the insulative layer 310, and may run along a part or the whole of the length of the cantilever beam.

In a preferred embodiment, the thin-film resistive layer 311 only runs along the first third of the total length. A gold conductive layer 312*a*, 312*b* is placed on the top surface of the thin-film resistive heater 311 at the near side of the thin-film resistive heater, and otherwise runs off the cantilever beam. Electrical current flows from a source placed some distance away, through the conductive layer 312*a*, into the thin-film resistive heater 311, and returns through the conductive layer 312*b*. The thin-film resistive heater 311 increases in temperature and provides an increase in temperature of the remaining layers 303, 309, 310 through conductive heat transfer. As the temperature increases in the main structural layer 303 and the secondary structural layer 309, the difference in TCE's will cause the entire cantilever beam to bend upwards. Depending upon the choice of materials, additional layers may be necessary as adhesion layers or diffusion barriers. These adhesion layers and diffusion barriers are not shown on the figure for simplicity.

Figure 4A:
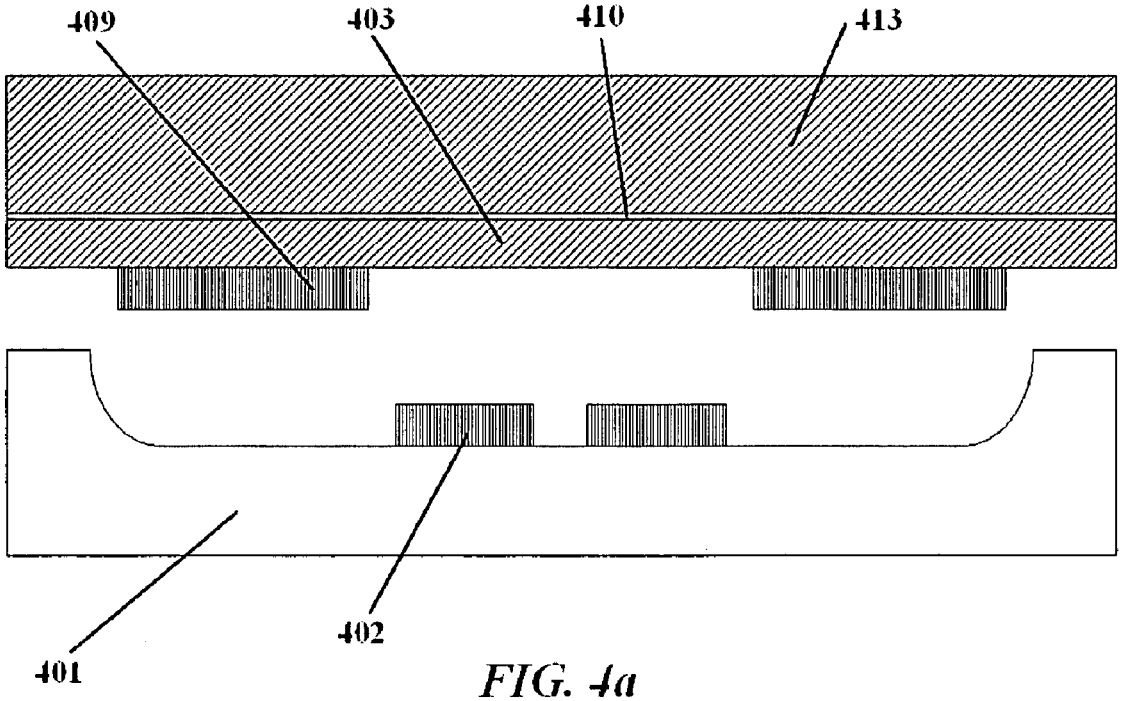
FIGS. 4*a*, 4*b*, 4*c* show the major steps of one method to fabricate and assemble the micro-electromechanical relay device. The sequence of assembly is FIG. 4*a*, FIG. 4*b* and then FIG. 4*c*.
Figure 4B:
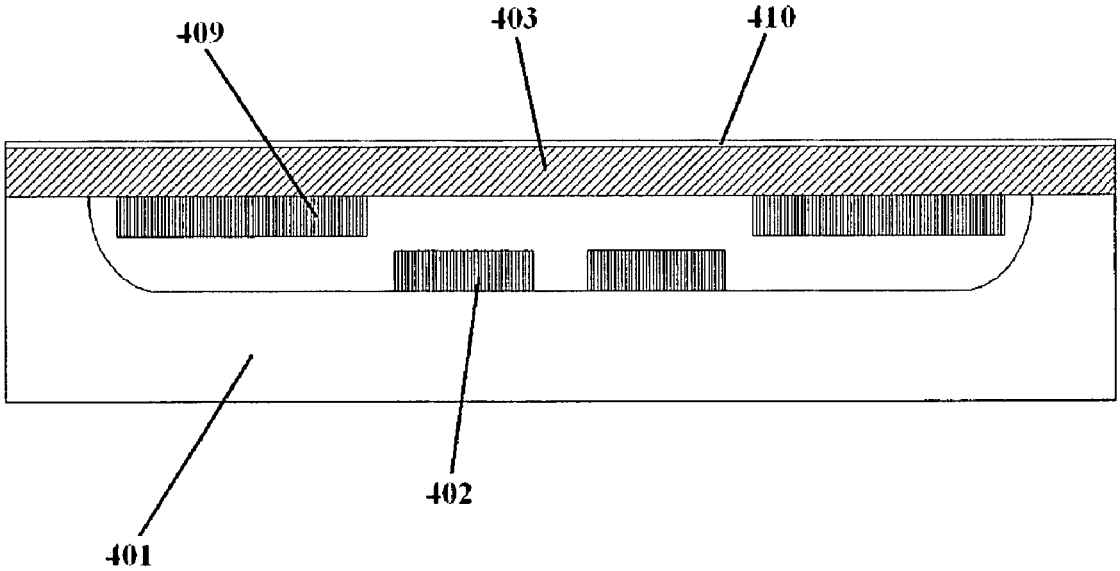
Figure 4C:
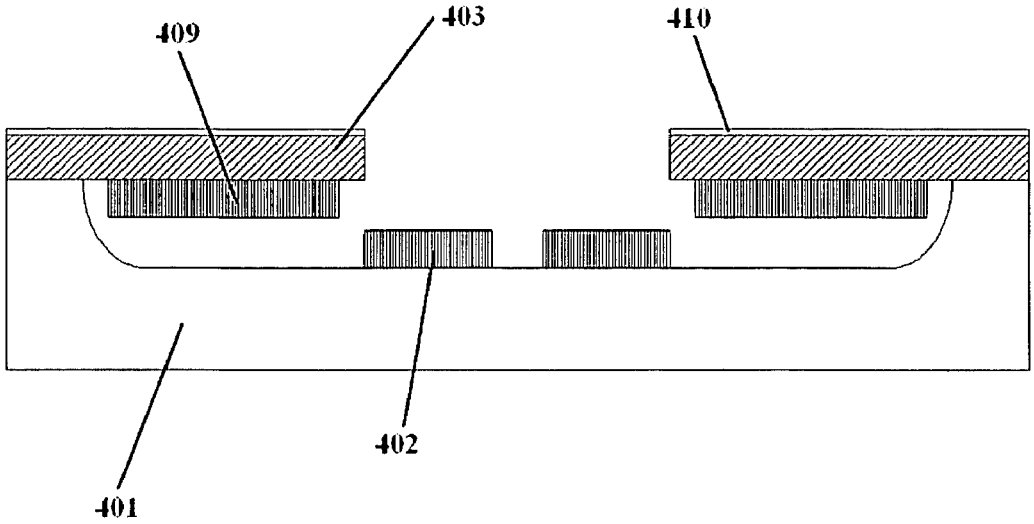

FIGS. 4*a*, 4*b*, 4*c* show one preferred method of fabricating and assembling the present micro-electromechanical relay. The fabrication method starts with the processing of two separate wafers. A top substrate, preferably an SOI wafer, which contains a handle wafer 413, a buried oxide layer 410, and a silicon device layer 403, is processed to have the necessary electrical conductors formed on the surface of the silicon device layer. These electrical conductors may include adhesion layers, diffusion barriers, etc. and are denoted by 409. A base substrate, preferably glass wafer 401 with a recessed area etched therein is also processed to form the necessary conductors within the recessed area. These electrical conductors may also include adhesion layers, diffusion barriers, etc. and are denoted as 402.

In FIG. 4*a*, the top substrate, an SOI wafer in this particular example, is aligned with the base substrate, a glass wafer in this particular case, for bonding. In FIG. 4*b*, the wafers are bonded together and the silicon handle wafer 413 is completely removed, preferably with a wet chemical etching process. Handle wafer removal can also be accomplished with plasma etching or chemical mechanical polishing methods. The bonding methods that can be used include anodic bonding, eutectic bonding, fusion bonding and are well documented in the prior art. In FIG. 4*c*, the final patterning and etching of the structural silicon 403 is done. In this step, the cantilever beams will be defined, along with the in-plane movement actuator and the shuttle structure. The shuttle structure and the in-plane actuator are not shown in the cross section drawing of FIG. 4*c*, but are depicted in FIG. 1 and FIG. 2.

Figure 5A:
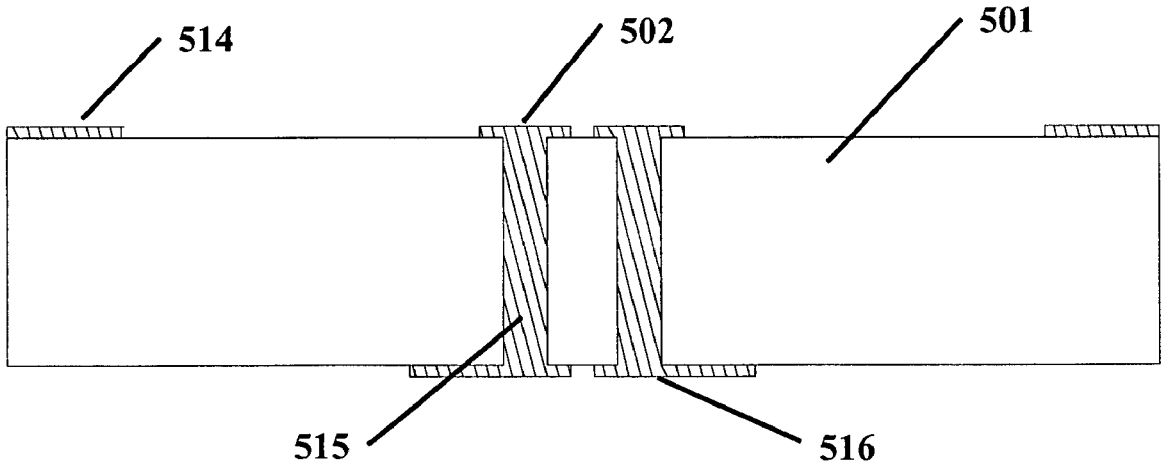
FIGS. 5*a*, 5*b*, 5*c* show the major steps of another method to fabricate and assemble the micro-electromechanical relay device. The substrate shown in FIG. 5*a* is a prefabricated base substrate with electrical vias.
Figure 5B:
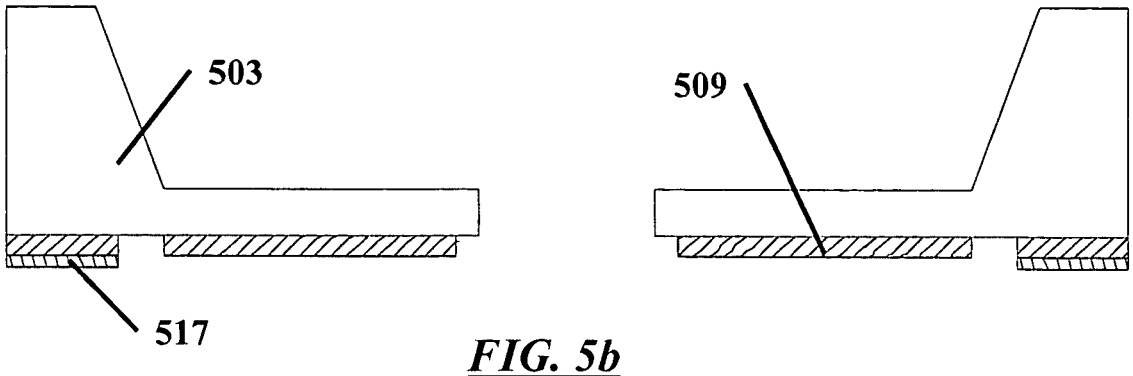
Figure 5C:
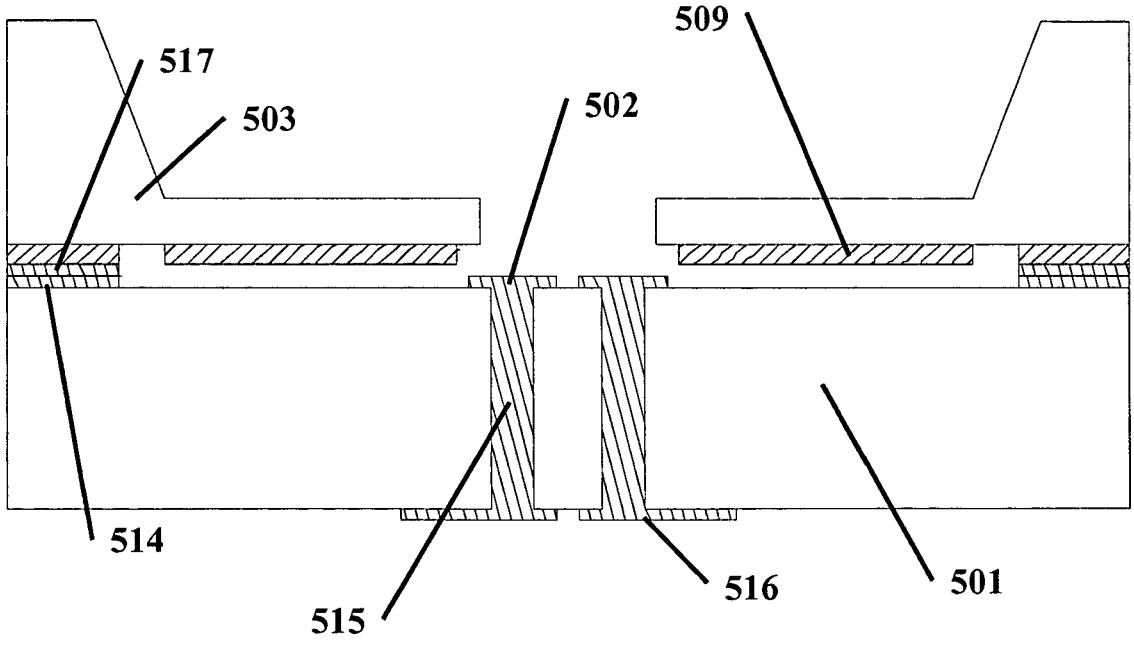

FIGS. 5*a*, 5*b*, 5*c* show another preferred method of fabricating and assembling the present micro-electromechanical relay. The fabrication method involves attaching a fully prefabricated top substrate, preferably silicon 503 to a fully prefabricated base substrate, preferably ceramic or glass 501 to complete the assembly of the micro-electromechanical relay.

FIG. 5*a* is a diagrammatic cross sectional view of the prefabricated base substrate. The base substrate 501 has fixed conductors 502 and 516 disposed on its first and second surfaces and electrically conductive via 515 through its thickness in desired locations. The electrical vias connect certain fixed conductors electrically between the first and second surfaces of the base substrate.

FIG. 5*b* is a diagrammatic cross sectional view of the prefabricated top substrate 503. The top substrate is thinned in certain areas to provide a primary structural layer 503 of desired thickness. A secondary structure layer 509, preferably of platted metal, is attached to the underside of the primary structure layer. The top substrate further comprises fully formed cantilever beams made of the primary and secondary structural layers, conductors, shuttle structures, and shuttle actuators, all (not shown for simplicity) formed prior to attachment to the base substrate.

FIG. 5*c* shows a diagrammatic view of the cross sectional view of a fully assembled micro-electromechanical relay. The assembly is made with bonding methods now known or hereafter developed such as eutectic metal bonding or low temperature solder process. The bonding process takes place in areas defined by the metal patterns 514 on the base substrate and 517 on the top substrate, which define the gap between the top and bottom substrates and establish electrical connections between the two surfaces.

Many variations and modifications can be made to the preferred embodiments and methods without departing from the principles of the present invention. All such variations and modifications are intended to be included herein within the scope of the present invention, as set forth in the following claims.

What is claimed is:

1. A micro-electromechanical relay, comprising:

a base substrate having a support surface;

a cantilever beam attached to the support surface, the cantilever beam having an actuatable free end;

the cantilever beam comprising structural layers with differing thermal coefficients of expansion, and the cantilever beam being actuatable by a change of temperature of the cantilever beam;

a shuttle movable on the base substrate by a shuttle actuator to and from a contact position between the actuatable free end of the cantilever beam and the substrate;

electrical contacts on at least two of the free end of the cantilever beam, the shuttle and the support surface such that movement of the actuatable free end of the cantilever beam towards the shuttle closes the electrical contacts; and the cantilever beam being arranged to move away from the substrate when actuated, to allow the shuttle to move under the free end of the cantilever beam, and to press against the shuttle when un-actuated.

2. The micro-electromechanical relay of claim 1 in which the support surface is electrically insulating, one of the electrical contacts is attached to the support surface and another of the electrical contacts is attached to the shuttle.

3. The micro-electromechanical relay of claim 1 further comprising:

a second cantilever beam attached to the support surface and having a second actuatable free end; and the shuttle in the contact position being between the second actuatable free end of the second cantilever beam and the substrate.

4. The micro-electromechanical relay of claim 1 in which the cantilever beam runs parallel to the support surface.

5. The micro-electromechanical relay of claim 4 in which the free end of the cantilever beam is movable perpendicularly to the substrate.

6. The micro-electromechanical relay of claim 1 in which the shuttle is movable in a plane parallel to the support surface.

7. The micro-electromechanical relay of claim 1 further comprising a thin-film heater attached to the cantilever beam, the thin-film heater being electrically isolated from the cantilever beam.

8. The micro-electromechanical relay of claim 1 in which the shuttle actuator is an electrostatic actuator.

9. The micro-electromechanical relay of claim 8 in which the electrostatic actuator is a comb drive.

10. The micro-electromechanical relay of claim 1 in which the shuttle actuator is a thermal actuator.

11. The micro-electromechanical relay of claim 10 in which the thermal actuator comprises a plurality of bent-beam actuators in series.

12. The micro-electromechanical relay of claim 1 in which the electrical contacts comprise:

a pair of electrical contacts on the support surface; and a third electrical contact on the shuttle, the third electrical contact having sufficient size to contact both of the pair of electrical contacts on the support surface when the free end of the cantilever beam is urged against the shuttle.

13. The micro-electromechanical relay of claim 12 further comprising a thin-film heater attached to the cantilever beam, the thin-film heater being electrically isolated from the cantilever beam.

14. The micro-electromechanical relay of claim 12 in which the electrical contact on the bottom surface of the cantilever beam is formed by a conductive layer on the bottom surface of the cantilever beam.

15. The micro-electromechanical relay of claim 12 in which the shuttle actuator is an electrostatic actuator.

16. The micro-electromechanical relay of claim 15 in which the electrostatic actuator is a comb drive.

17. The micro-electromechanical relay of claim 12 in which the shuttle actuator is a thermal actuator.

18. The micro-electromechanical relay of claim 17 in which the thermal actuator comprises a plurality of bent-beam actuators in series.

19. The micro-electromechanical relay of claim 1 in which the electrical contacts comprise:

an electrical contact on the support surface; and a contact on the shuttle that is electrically connected to a signal conductor terminal.

20. The micro-electromechanical relay of claim 1 in which the electrical contacts comprise:

an electrical contact on the bottom surface of the cantilever beam; and an electrical contact on the shuttle.

21. The micro-electromechanical relay of claim 1 in which the cantilever beam in an un-actuated condition remains pressed against the shuttle and thereby forms a latching micro-electromechanical relay.

22. A micro-electromechanical relay, comprising:

a base substrate having a support surface;

a cantilever beam attached to the support surface, the cantilever beam having an actuatable free end;

the cantilever beam comprising structural layers with differing thermal coefficients of expansion, and the cantilever beam being actuatable by a change of temperature of the cantilever beam;

a shuttle movable on the base substrate by a shuttle actuator to and from a contact position with the actuatable free end of the cantilever beam; and electrical contacts on at least two of the free end of the cantilever beam, the shuttle and the support surface such that movement of the actuatable free end of the cantilever beam towards the shuttle closes the contacts.

* * * * *